United States Patent [19]

Boyen et al.

[11] 4,218,898

[45] Aug. 26, 1980

[54] TIMER, STEPPING DEVICE, HINGE AND LAUNDRY HANDLING MACHINE

[75] Inventors: Lodewijk J. T. Boyen, Alleur; René N. J. D'Huys, Tongeren, both of Belgium

[73] Assignee: ITT Industries, Inc., New York, N.Y.

[21] Appl. No.: 940,692

[22] Filed: Sep. 8, 1978

[51] Int. Cl.[3] ..... D06F 33/06; D06F 39/14

[52] U.S. Cl. ..... 68/12 R; 74/142; 318/282

[58] Field of Search ..... 318/266, 282, 286; 68/12 R, 140, 153, 173

[56] References Cited

U.S. PATENT DOCUMENTS

| | | | |
|---|---|---|---|
| Re. 26,118 | 11/1966 | Swenson | 318/286 X |
| 1,264,340 | 4/1918 | Simon et al. | 318/282 |
| 1,768,564 | 7/1930 | Campbell et al. | 318/286 |
| 2,619,822 | 12/1952 | Wible | 68/12 R |
| 2,624,464 | 1/1953 | Morrison | 68/12 R X |
| 2,701,857 | 2/1955 | Gess | 318/286 X |
| 3,024,638 | 3/1962 | Gibson | 68/12 R |
| 3,221,862 | 12/1965 | Taylor | 68/12 R |
| 3,667,651 | 6/1972 | Shapiro | 318/286 X |

FOREIGN PATENT DOCUMENTS

| | | | |
|---|---|---|---|
| 207966 | 10/1966 | Sweden | 68/12 R |

*Primary Examiner*—Philip R. Coe

*Attorney, Agent, or Firm*—John T. O'Halloran; Jeffrey P. Morris

[57] ABSTRACT

A reversible drum for a laundry handling machine is described wherein the drum motor drives a timer, eliminating the use of two motors. The timer includes a bistate device driven by the motor and controlling its sense of rotation.

2 Claims, 13 Drawing Figures

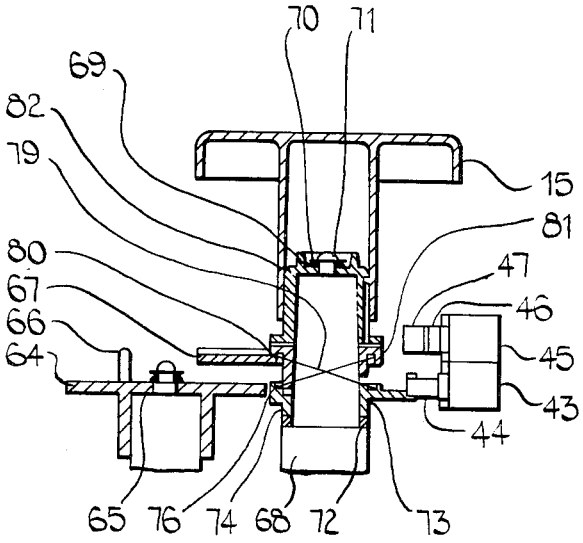
Fig. 11
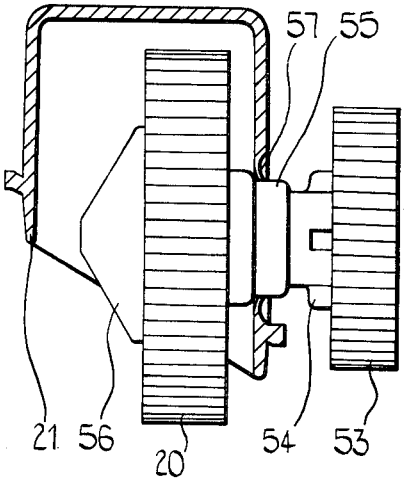
Fig. 10
Fig. 13
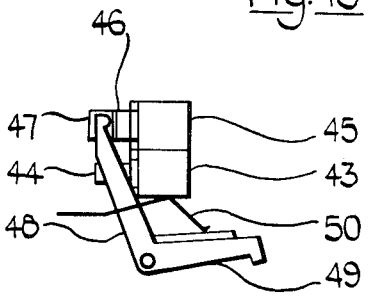

TIMER, STEPPING DEVICE, HINGE AND LAUNDRY HANDLING MACHINE

The present invention relates to a timer for a machine, e.g. for a laundry handling machine, using a motor whose sense of rotation can be reversed.

Such a timer is generally known in the technique, e.g. from U.S. Pat. No. 3,568,476 which describes a laundry handling machine which includes a motor whose sense of rotation may be repeatedly reversed to oscillate a drum containing the laundry to be handled and which further includes a timer which is driven by another motor because this timer always has to be driven in a same sense independently from the sense of rotation of the drum driving motor. The use of two separate motors obviously makes the machine relatively expensive.

An object of the present invention is to provide a timer of the above type but which does not present this drawback.

According to the invention this object is achieved due to the fact that said timer includes a bistate device driven from said motor and controlling its sense of rotation.

Another characteristic feature of the present timer is that said bistate device moves from a first to a second state after said motor has performed a predetermined angle of rotation in one sense thereby reversing said sense of rotation and that after said motor has performed another predetermined angle of rotation in the opposite sense, said bistate device moves from said second to said first state.

Still another characteristic feature of the present timer is that said bistate device is coupled with a counter which counts said changes of state of said bistate device.

Yet another characteristic feature of the present timer is that said bistate device and said counter are formed by the driving and driven members of a one-way clutch mechanism respectively, whereby said driven member is angularly displaced together with said driving member only when said driving member moves in a predetermined sense of rotation and remains stationary when said driving member angularly moves in the opposite sense of rotation.

Thus when said motor rotates at a constant speed the number registered by the counter is a measure of the duration of operation of the motor.

The present invention also relates to a stepping device for angularly displacing a rotatable driven member in a stepwise manner from a driving member which is alternately rotated in two opposite senses of rotation by driving means.

Such a stepping device is already known from Belgian Pat. No. 723,308 (E. STEENACKERS et al 1-4-1). This known stepping device was designed as an asynchronous mechanical counter to record the number of telephone conversations and is not particularly adapted to be used in a timer of the above described type, i.e. as a timer which includes a bistate device driven from a motor and controlling the sense of rotation thereof and which further includes a counter to count the changes of state of this bistate device.

Another object of the present invention is to provide a stepping device of the above type but which is particularly adapted to be used in the timer briefly described above.

According to the invention this object is achieved by the fact that said driving and driven members form part of a one-way clutch mechanism, whereby said driven member is angularly displaced together with said driving member only when said driving member angularly moves in a predetermined one of said two senses of rotation.

This stepping device is particularly adapted to be used in the above described timer because the driving and driven members of the clutch mechanism included in this stepping device may be used for the bistate device and the counter of this timer respectively.

The present invention also relates to a laundry handling machine which includes a motor driving a drum housed in a vat with a cover and adapted to contain said laundry, the sense of rotation of the drum being able to be reversed, and which further includes a timer to measure the duration of laundry handling operations.

More particularly, a further object of the present invention is to ensure safety of operation of this machine by preventing motion of the drum when the cover of the machine is open.

According to the invention this object is achieved due to the fact that this timer includes the clutch mechanism mentioned above of which the driven member controls a first contact device included in the operating circuit of said motor and which is operated when said driven member reaches a predetermined angular end position, the operation of said motor being then stopped and that this machine further includes a control member which is operated upon said cover being closed and which controls said first contact device in such a manner that said first contact device only closes said operating circuit of said driving means when said cover is closed.

The present invention also relates to a hinge. This hinge is particularly characterized in that it comprises a female member with opposite beak-shaped elements delimiting an insertion opening which is reduced at its lower part by a rib protruding towards the inside of said opening, and a male member with a lower edge and a cavity, all in such a manner that when said male member is inserted into said insertion opening of said female member and is slightly inclined said lower edge is engaged in the reduced portion of said opening and below said rib, said rib then engaging in said cavity.

Still another characteristic feature of the present hinge is that said female member is provided with a pair of lateral abutments, said male member making contact with said lateral abutments after having been inserted in said insertion opening, said lateral abutments maintaining said member in a substantially vertical position.

An advantage of such a hinge is that the constituent members thereof may be very easily attached to and removed from each other.

In accordance with the present invention a preferred embodiment thereof relates to a portable laundry handling machine with a vat housing a motor driven drum, containing the laundry to be handled, and with a cover housing a new timing device for measuring the duration of the laundry handling operations and which is driven from the motor able to alternately drive the drum in opposite directions.

The above mentioned and other objects and features of the invention will become more apparent and the invention itself will be best understood by referring to the following description of an embodiment taken in conjunction with the accompanying drawings wherein:

FIG. 10 is a cross-section along line X—X, however on another scale of part of FIG. 8, the skirt 21 being represented;

FIG. 11 is a cross-section along line XI—XI of FIG. 8;

FIG. 13 is a side view of FIG. 8 considered in the direction of the arrow XIII.

Figure 1:
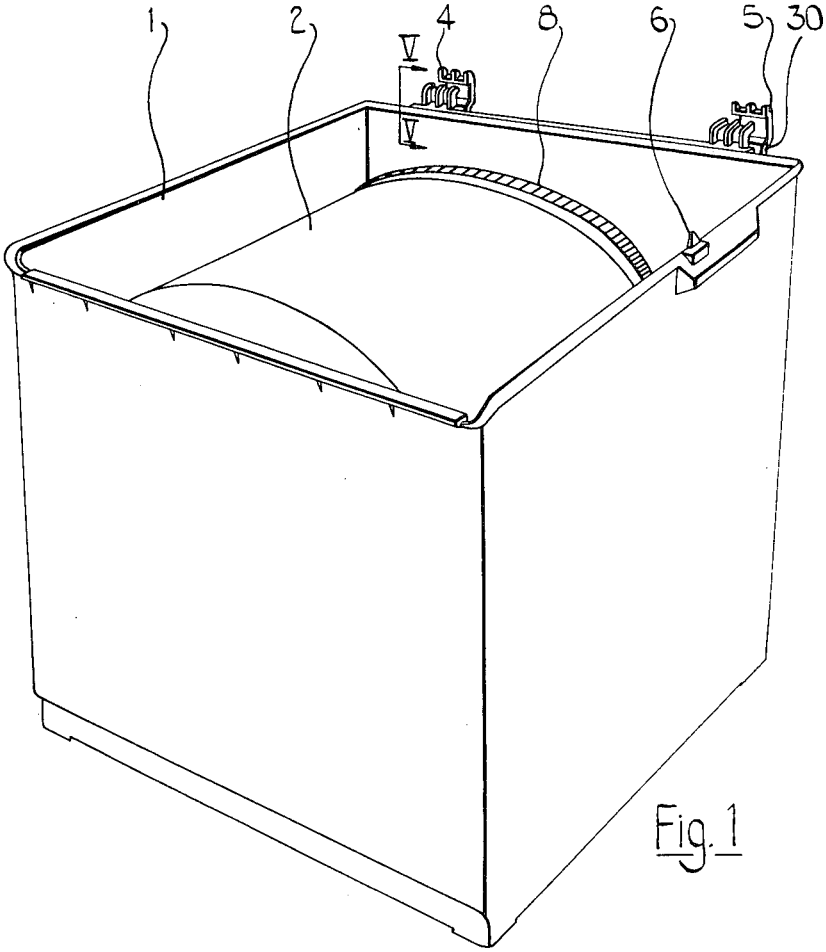
FIG. 1 is a perspective schematic view of the vat of a laundry handling machine according to the invention.
Figure 2:
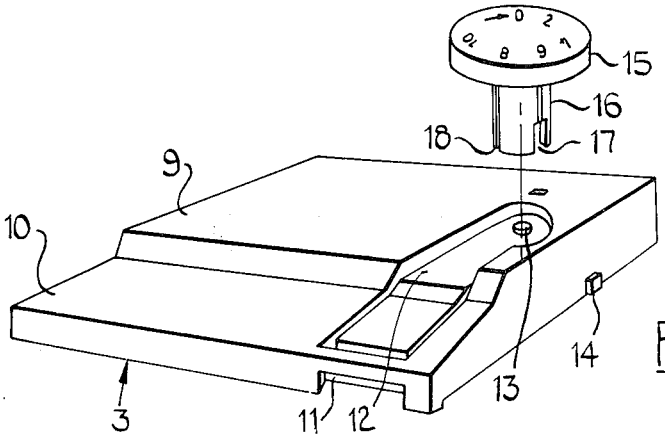
FIG. 2 is a perspective schematic view of the cover of this machine and of a selection knob, however represented on a different scale.
Figure 3:
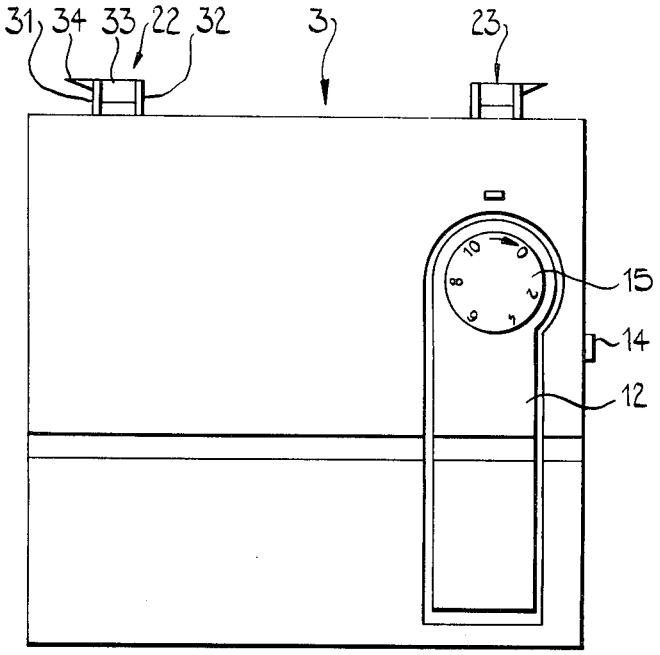
FIG. 3 is a top plan view of the cover of FIG. 2, however on another scale.

The laundry handling machine and more particularly the washing machine shown in FIGS. 1 to 7 consists of a vat 1, a drum 2 and a hollow cover 3.

The vat 1 (FIG. 1) which houses the drum 2 is provided with a pair of female hinge members 4 and 5 with a protrusion 6 for actuating a main switch control lever 7. The drum 2 which mainly consists of a cylindrical casing and two circular side walls is rotatably mounted due to these side walls being each provided with a centrally located pivot pin (not shown) which is mounted in a bearing (not shown) provided at the inner side of a wall of the vat 1. The drum 2 may be driven due to its peripheral outer edge being provided with a toothed ring 8. Preferably this ring 8 forms part of a side wall and both this ring and side wall are made of a synthetic material as a single unit.

At its upper side the hollow cover 3 (FIGS. 2,3) has a substantially horizontal rear portion 9 and an inclined front portion 10 which is provided with a handgrip 11 to open the cover 3. A recess 12 made in the rear portion 9 gives access to the inclined front portion 10 and this rear portion is provided with a round annular part 13. This recess 12 facilitates the evacuation of liquid which could possibly be present on top of the machine and the raised annular part 13 prevents any ingress of liquid into the hollow cover 3. At its upper side the cover 3 is further provided with a lateral protection cap 14 for the above mentioned control lever 7. A programme selection knob 15 having a hollow cylindrical stem 16 which is relatively resilient due to the presence of slits 17 and 18 fits snugly into the annular part 13 and due to its resiliency the knob 15 may be easily slid on the upper part of a clutch mechanism mounted inside the cover 3, as will be explained later. The knob 15 permits to select a programme among a plurality of programmes, the durations of which are indicated by the figures 0, 2, . . . , 10 on the upper surface of the knob.

At its lower side the cover 3 (FIG. 4) is provided with an aperture 19 through which projects a driving wheel 20 which is partially enclosed by a skirt 21 preventing the ingress from any liquid from the vat 1 into the hollow cover 3. This skirt 21 has the shape of half a hollow ring.

Finally the cover 3 is also provided with male hinge members 22 and 23 (FIG. 4) able to cooperate with the female hinge members 4 and 5 (FIG. 1) respectively, in such a way that the cover 2 on the one hand may be easily removed and at the other hand may be held open in a stable position.

Because the female hinge member 4 and 5 are identical and as the same is true for the male hinge members 22 and 23, only the female hinge member 4 and the male hinge member 22 are described in detail hereinafter.

The female hinge member 4 (FIG. 5) is integral with a triangular rib 24 at the outside of the real wall of the vat 1 and comprises two beak-shaped members 25 and 26 which are pointing towards each other and which enclose a hinge opening 27. At its lower end the opening 27 is restricted due to the presence of an enlarged upper portion 28 of this rear wall. The latter portion 28 is provided on the one hand with a rib 29 directed towards the inside of the opening 27 and on the other hand with two lateral abutments, such as 30. These extend at both sides of the beak-shaped part 26 and in a direction parallel to the rear wall of the vat 1.

Figure 4:
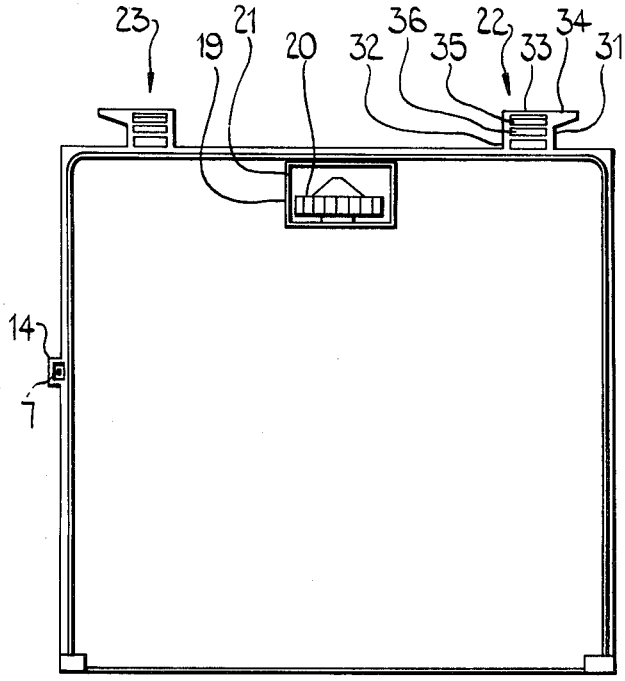
FIG. 4 is a plan view of the underside of this cover, also on another scale.
Figure 5:
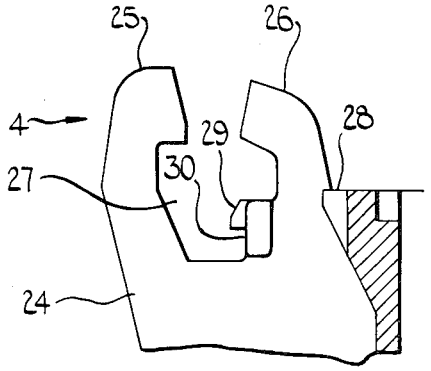
FIG. 5 is a cross-sectional view according to line V—V of FIG. 1, however, on another scale, showing a female hinge member of the vat.

The male hinge member 22 (FIGS. 3, 4, 6, 7) comprises two parallel substantially triangular flanges 31 and 32 which are united by a flat portion 33, the flange 31 being provided with a lateral triangular extension 34 substantially parallel to the rear wall of the vat 1. At its bottom the flat portion 33 has two cavities 35 and 36 (FIG. 4).

Figure 6:
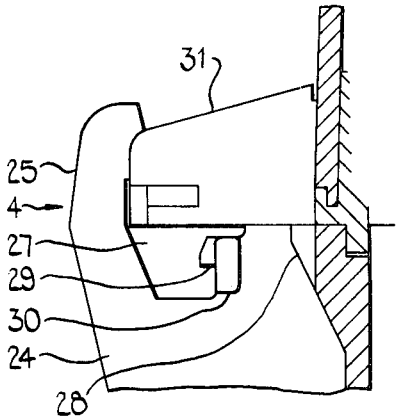
FIG. 6 is a view similar to FIG. 5 but wherein a male hinge member of the cover is engaged with the female hinge member of the vat, the cover being shown in the closed position.

In the closed position of the cover, as shown in FIG. 6, the bottom part of the male hinge member 22 rests on the enlarged portion 28 of the rear wall of the vat 1, whilst its flat portion 33 is located between the lower portions of the beak-shaped members 25 and 26.

Figure 7:
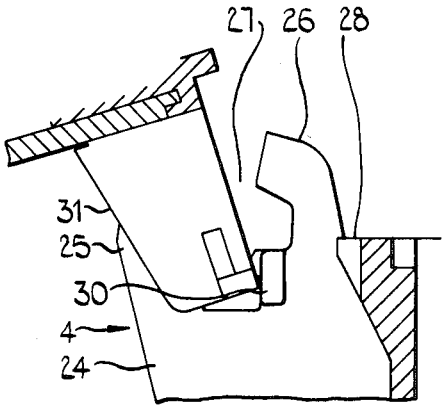
FIG. 7 is a view similar to FIG. 6 but with the cover represented in the open position.

When the cover 3 is brought in its open position, shown in FIG. 7, the rear edge of the flat portion 33 of the male hinge member 22 slides on the adjacent inside face of the beak-shaped member 25 and at the end of an angular movement somewhat larger than 90° the lower edge of the male hinge member 22 is located below the rib 29 of the female member 4, the latter rib being engaged in the cavity recess 35 of the flat portion 3 of the male hinge member 22. The lower ends of the triangular flanges 31 and 32 of this male member 22 make contact with the lateral abutments, such as 30 of the female hinge member 4. Thus the cover is held open in a stable position, the rib 29 preventing the cover to be withdrawn in the closed position. However, to remove the cover 3 it is sufficient to bring it in vertical position and to excert an upward traction thereon.

It should be pointed out that the male hinge members 22, 23 (FIG. 4) may be used to wind up an electric cord which is then located between the rear part of the cover and the lateral extensions 34 of these male hinge members.

Principally referring to FIGS. 8 to 13 the timer shown therein includes the above driving wheel 20, the main switch control lever 7 and the programme selection knob 15. This driving and timing mechanism further includes an electric motor 37 having two windings 38 and 39 which are connected at their one ends to the mains 97. At their other ends these windings 38 and 39 are interconnected by a capacitor 40, and are further individually connected via protecting resistors 41 and 42 to the stationary contacts of a change-over microswitch 43 having a movable armature 44. This movable armature 44 is connected to the mains 97 in series with a main switch 45 having a movable armature 46.

The latter armature 46 is in its turn controlled by a movable lever 47 which is pivoted at one end and which is normally held in a position, wherein the make contact 45 is open. This is done by one arm 48 of the L-shaped main switch control lever 7. The latter comprises another arm 49 which is pressed downwardly towards the bottom plate of the cover 3 by a blade spring 50.

The electric motor 37 (FIGS. 8, 10) has a horizontal drive shaft 51 in the form of a worm-gear and its frame is provided with a fixed axle 52 which extends in parallel to the drive shaft 51. This drive shaft 51 engages with a worm wheel 53 rotatably mounted on the fixed axle 52 and having a hub 54 which is united by axial pressure to the hub 55 of the drive wheel 20 which is also rotatably mounted on the axle 52. At its end away from the worn wheel 53 a cap 56 is secured to this axle 52. The hub 55 of the drive wheel 20 fits in an opening of the skirt 21 having a collar 57. The hub 55 and the collar 57 are made of different synthetic materials with suitable friction coefficients to simultaneously ensure tight sealing and rotation of the hub 55. The materials used are more particularly polyacetal and polyamide 6.

A drive belt 58 is arranged around the hub 54 of the worm wheel 53 and in the peripheral groove of a pulley 59 which is integral with a worm 60, both the pulley 59 and the worm 60 being rotatably mounted about a horizontal axle 61 fixed in supports 62 and 63 both forming part of the bottom plate of the cover 3. The worm-gear 60 engages with a worm wheel 64 rotatably mounted around a vertical axle 65 and bearing a vertical stud 66 adapted to cooperate with a radial control arm 67 of a clutch mechanism. This clutch mechanism, a control member which controls the movable armature 44 and the programmed selection knob 15 are all fixed on a vertical frustoconical peg 68 forming part of the cover 3. More particularly the clutch mechanism is fixed on this peg 68 by means of a spring washer 69, a washer 70 and a screw 71 which is screwed in a hole made in the top of the peg 68.

The vertical peg 68 has a lower portion with a larger diameter than its upper part and thus delimits a peripheral shoulder which supports an annular friction ring 72. A control member 73 has an annular lower part 74 which rests on the friction ring 72 and is further provided with a lateral cam member 75 having a radius variable over an angle of about 60°. This cam member 75 controls the movable armature 44 of the change-over microswitch 43. The control member 73 further has an upper surface with an annular groove 76 the inside wall of which has two opposite recesses 77, 78. This annular groove 76 houses the bottom part of a coiled spring 79. The upper part of this spring is housed in a similar annular groove 80 (FIG. 11) in the bottom part of a lower clutch member 81 of the clutch mechanism further comprising an upper clutch member 82. The lower clutch member 81 is provided with the above mentioned radial control arm 67 and the inside wall of the annular groove 80 in the bottom part of this lower clutch member 81 is provided with two opposite protrusions 83 and 84 fitting in the recesses 77 and 78 of the control member 73. However, the angular width of the protrusions 83, 84 is equal to 30° while that of the recesses 77, 78 is equal to 46° for reasons which will be explained later. On its upper side the lower clutch member 81 is provided with four teeth 85 to 88 at 90° interval which cooperate with 24 regularly spaced teeth, such as 89, on the underside of the ring-shaped base 90 of the upper clutch member 82. This ring-shaped base 90 is also provided with a lateral cam member 91 having a radius variable over an angle of about 60° and controlling the movable armature 47. The upper clutch member 82 further has a dome-shaped upper portion 92 having a plurality of windows such as 93 and recesses such as 94. The dome-shaped portion 92 is further provided with a rib 95 and with an abutment 96.

The control knob 15 is slidden on the dome-shaped portion 92 of the upper clutch member 82 in such a way that its slit 17 fits around the rib 95 and that its lower edge makes contact with the abutment 96.

The operation of the above described washing machine is as follows.

Figure 9:
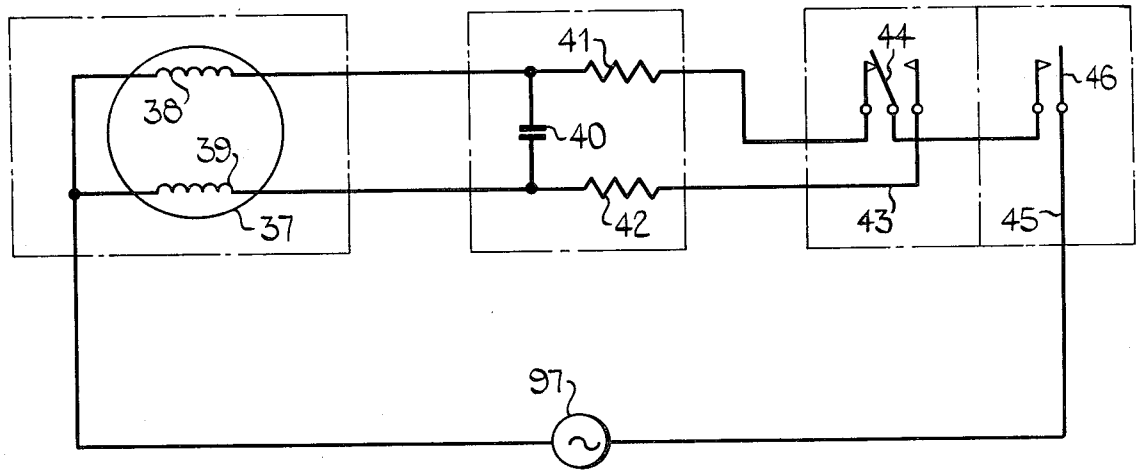
FIG. 9 is a schematic view of the electric connections between various parts of the timer of FIG. 8.
Figure 12:
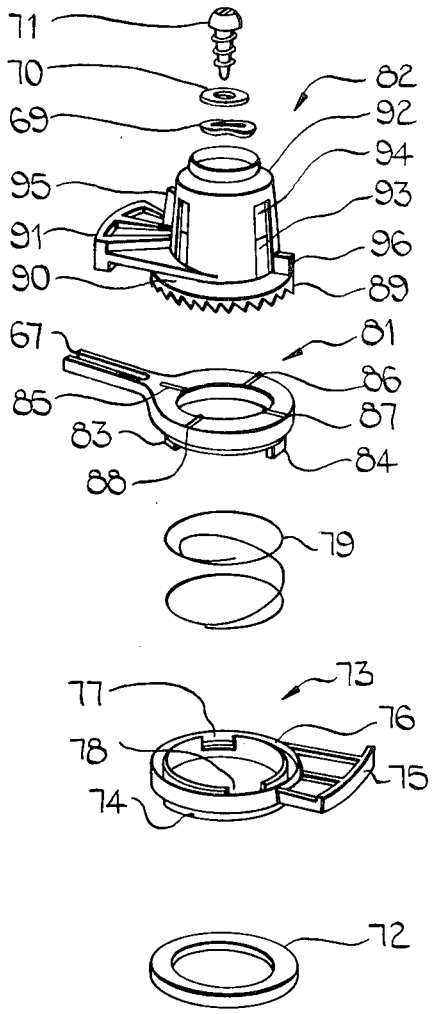
FIG. 12 is an exploded perspective view of part of FIG. 11, however on another scale.

After the vat 1 has been filled with a washing solution and with laundry, the cover 3 is closed due to which the drive wheel 20 is brought into engagement with the toothed ring 8 of the drum 2 and the control arm 49 is pivoted in anti-clockwise direction (FIG. 13) by the protrusion 6 on the vat 1 and against the action of the spring blade 50. Thus the movable armature 47 is enabled to move to a position wherein the main switch 45 is closed (FIG. 9). By means of the control knob 15 the duration of a washing programme is selected, the rotation of this knob 15 entailing the rotation of the upper clutch member 82. The latter member is thus brought in a predetermined rest position wherein it is located at a predetermined angle from a final position. In the latter position the upper clutch member 82 will bring the movable armature 47 in a position wherein the microswitch 45 will open the electric circuit of the motor 37 (FIG. 9).

It is for instance supposed that the stud 66 on the worm wheel 64 is in a position wherein it makes contact with the left hand side (FIG. 8) of the control arm 67 of the clutch mechanism 81, 82. This control arm 67 is in its rest position and so is the rotation reversal control member 73. The microswitch 43 occupies the position shown in FIG. 9.

When the mains 97 is now connected to the washing machine the electric motor 37 is operated so as to rotate the washing drum 2 through the intermediary of the worm-gear 51, the worm wheel 53 and the drive 20 engaging with the toothed ring 8 of the drum 2. On the other hand, the worm wheel 64 is rotated in clockwise direction (FIG. 8) via the worm-gear 51, the worm wheel 53, the belt 58, the pulley 59 and the worm-gear 60. As a consequence the stud 66 on this worm wheel 64 describes a circular path in clockwise direction and after a full rotation it comes into contact with the right hand side (FIG. 8) of the control arm 67 of the lower clutch member 81. It then communicates an angular displacement to the latter arm 67.

During this displacement the four teeth 85 to 88 of the lower clutch member 81 slip under those, such as 89, of the upper clutch member 82 which is maintained stationary due to the pressure exerted thereon by the spring washer 69 secured on the peg 68 by means of the washer 70 and the screw 71. This pressure could possibly be increased by cutting friction lips from the material now forming the bottom of the cavities such as 94 in the dome-shaped upper portion 92 of the upper clutch member 82. These friction lips would then make contact with the peg 68.

Figure 8:
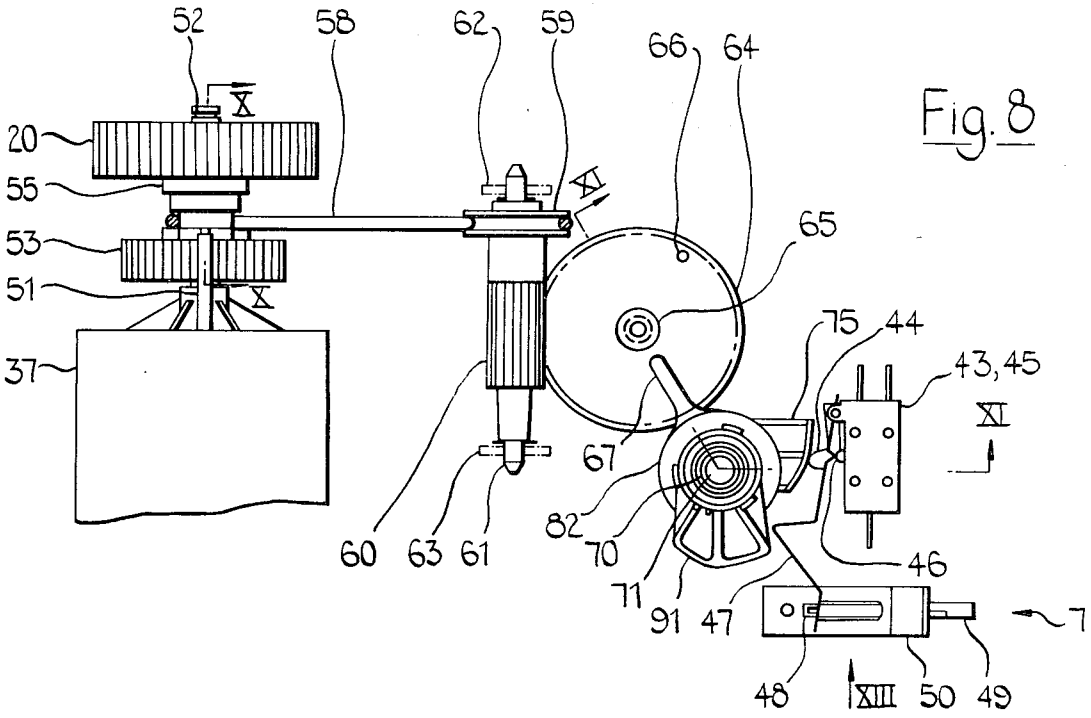
FIG. 8 is a top plan view of a timer according to the invention, however with the skirt 21 and the knob not being represented.

Due to the fact that the protrusions 83, 84 of the lower clutch member 81 engage in the corresponding recesses 77, 78 of the rotation reversal control member 73, the angular displacement of the control arm 67 is communicated to the latter control member 73. However, due to the angular width (30°) of each of the protrusions 83, 84 being smaller by 16° than those (46°) of each of the recesses 77, 78 the lower clutch member 81 moves freely over an angle of 16° before driving the control member 73 which is pressed against the friction ring 72 by the spring 79. Because each of the teeth, such as 89, of the upper clutch member 86 has a radial width of 15° it is clear that during this angular displacement of the lower clutch member 81 over 16° this member is moved over a single tooth with respect to the upper clutch member 82. During the further movement of the control arm 67 the control member 73 is driven so that its cam member 75 thereof gradually displaces the movable armature 44 of the microswitch 43 and at the end of its movement the latter armature 44 is in a position different from that shown in FIG. 9. As a consequence the direction of rotation of the electric motor 37 is reversed, so that as well the washing drum 2 as the worm wheel 64 then start rotating in a direction opposite to that in which they were previously rotating. More particularly, the stud 66 on the worm wheel 64 then starts describing a circular path in anti-clockwise direction (FIG. 8). After a complete rotation this stud 66 comes into contact with the left hand side (FIG. 8) of the control arm 67 of the lower clutch member 81 and pushes the latter arm 67 back into its rest position. Hereby the four teeth 85 to 88 of this lower clutch member 81 engage with four adjacent teeth, such as 89, of the ring-shaped base 90 of the upper clutch member 82. Thus the latter clutch member 82 and its cam member 91 are also angularly displaced in a clockwise direction (FIG. 8) over a predetermined angle against the action of the spring washer 69.

Again due to the fact that the protrusions 83, 84 of the lower clutch member 81 engage in the corresponding recesses 77, 78 of the rotation reversal control member 73, the angular displacement of the control arm 67 is communicated to the latter control member 73. However, due to the angular width (30°) of each of the protrusions 83, 84 being smaller by 16° than those (46°) of each of the recesses 77, 78 the lower clutch member 81 moves over an angle of 16° before driving the control member. It is clear that during this angular displacement of the lower clutch member 81 over 16° the upper clutch member 82 is moved over a single tooth. During the further movement of the control arm 67 the reversal control member 73 is driven so that its cam member 75 gradually displaces the movable armature 44 of the microswitch 43 and at the end of its travel the latter is again in the position shown in FIG. 9. As a consequence the direction of rotation is again reversed.

It should be pointed out that the aim of the recesses 77, 78 having a larger angular width than the protrusions 83, 84 engaged therein is to delay the operation of the microswitch 43 by the control member 73. Thus it is ensured that the direction of rotation is not reversed before the lower clutch member has performed one angular step in one direction or both the lower and upper clutch members have performed a single angular step in the other direction.

From the above it follows that after two complete rotations of the stud 66 the cam member 91 of the upper clutch member 82, and therefore also the programme selection knob 15 connected therewith both are displaced over an angular step of 15° corresponding to one tooth of this clutch member. Because the rotation of the stud 66 is performed at a constant speed such an angular step is executed after a constant period of time. In other words the displacement of the cam member 91 of the upper clutch member 82 is timed.

Because during its angular displacement the latter cam member 91 is brought into contact with the movable armature 47 which in its turn exerts a pressure on the movable armature 46 of the microswitch 45, it is clear that after a number of angular steps of the cam member 91, i.e. after a predetermined time corresponding to the programme selected by means of the knob 15, the microswitch 45 is opened. Due to this the operating circuit of the electric motor 37 is opened. This motor is substantially and immediately stopped due to the high friction between the various driven members.

It should be noted that the driving lower clutch member 81 can be considered as a bistate device and that it could possibly be replaced by an electronic circuit. Moreover, it is clear that the above described device is a timer as well as a stepping device.

While the principles of the invention have been described above in connection with specific apparatus, it is to be clearly understood that this description is made only by way of an example and not as a limitation on the scope of the invention.

We claim:

1. In a laundry handling machine having a drum and a vat provided with a cover, wherein:

said cover includes an upper surface having a rear portion with a recess therein and an inclined front portion, an annular part in said recess with said annular part raised with respect to the recess, a washing program selection knob having a hollow stem with said hollow stem fitting into said annular part;

a laundry machine driven member having a dome-shaped part with said hollow stem being slid on said dome-shaped part, a rib on said dome-shaped part, said hollow stem having at least a first slit fitting around said rib; and a driven bistate device operably connected to said driven member, a timer including a motor reversible by said bistate device for changing the direction of rotation of said drum at a predetermined angle of rotation of said drum.

2. A laundry handling machine according to claim 1, wherein said hollow stem further includes at least a second slit for increased resiliency of said hollow stem.

* * * * *